US005429258A

United States Patent [19]

Rey

[11] Patent Number: 5,429,258

[45] Date of Patent: Jul. 4, 1995

[54] BOTTLE CLOSURE WITH INTERFITTING CROWN AND STOPPER

[75] Inventor: Luis R. Rey, New York, N.Y.

[73] Assignee: KLR Products, Inc., New York, N.Y.

[21] Appl. No.: 271,626

[22] Filed: Jul. 7, 1994

[51] Int. Cl.[6] ..... B65D 39/16

[52] U.S. Cl. ..... 215/354; 215/364

[58] Field of Search ..... 215/277, 320, 321, 325, 215/354, 316, 364, 200, 317; 220/254, 255, 256

[56] References Cited

U.S. PATENT DOCUMENTS 1,989,218 1/1935 Villanyi ..... 215/364

3,070,251 12/1962 Mangravite ..... 215/364 X 3,172,555 3/1965 Honnorat ..... 215/364

3,533,528 10/1970 Rubin ..... 215/364

4,460,100 7/1984 Libit ..... 215/320 X

*Primary Examiner*—Stephen P. Garbe

*Assistant Examiner*—Nathan J. Newhouse

*Attorney, Agent, or Firm*—Kirchstein, Ottinger, Israel & Schiffmiller

[57] ABSTRACT

A perfume bottle closure includes a stopper and a crown. A plurality of projections on the stopper are received with a snap-type action in corresponding recesses formed within the crown.

9 Claims, 1 Drawing Sheet

BOTTLE CLOSURE WITH INTERFITTING CROWN AND STOPPER

BACKGROUND OF THE INVENTION

1. Field of the Invention

This invention generally relates to a bottle closure and, more particularly, to a closure for a bottle containing an evaporatable liquid, such as perfume.

2. Description of the Related Art

Perfume loses its aroma and evaporates when left uncovered in a perfume bottle. It is known to close a glass perfume bottle with an all-glass closure. However, the closure must be machined to fairly tight tolerances to reliably seal the bottle. Plastic closures have replaced the all-glass closures in order to eliminate the requirement for machining glass to tight tolerances. However, all-plastic closures are not desirable for all applications. Attempts have been made to make closures of both plastic and glass. However, such attempts have not proven to be altogether satisfactory either because of separation between the plastic and the glass, or because of the relatively high cost of manufacture.

SUMMARY OF THE INVENTION

Objects of the Invention

It is a general object of this invention to advance the state-of-the-art of bottle closures.

Another object of this invention is to provide a part-glass, part-plastic, bottle closure, particularly suited to close perfume bottles.

Still another object of this invention is to provide a reliable perfume bottle closure which is inexpensive in manufacture and durable in construction.

Features of the Invention

In keeping with these objects and others which will become apparent hereinafter, one feature of this invention resides, briefly stated, in a bottle closure which comprises a stopper and a crown. The stopper has an inner plug portion which extends along a longitudinal axis, and an outer skirt portion which extends circumferentially around the axis. The skirt portion has a plurality of projections extending radially of the axis and outwardly away from the skirt portion. The crown has a corresponding plurality of interior recesses extending radially of the axis. The recesses receive the projections with a snap-type action to mount the crown on the stopper.

In the preferred embodiment, the inner plug portion has a blind bore, and the crown has a mounting pin, both of which extend along the axis. The pin is mounted in the bore.

The stopper is preferably constituted of a molded synthetic plastic material, while the crown is constituted of a glass material. Preferably there are three projections and three recesses. The projections all diverge apart from one another outwardly of the skirt portion. Adjacent projections extend along radial lines that include an acute angle with each other. Advantageously, each acute angle is about 30°.

The snap-type mounting of the glass crown and the plastic stopper assures a reliable, durable fit without sacrificing the sealing qualities of the plastic stopper or the aesthetics of the glass crown. Assembly costs are much reduced, and a secure mounting between the glass crown and the plastic stopper is achieved.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

Figure 3:
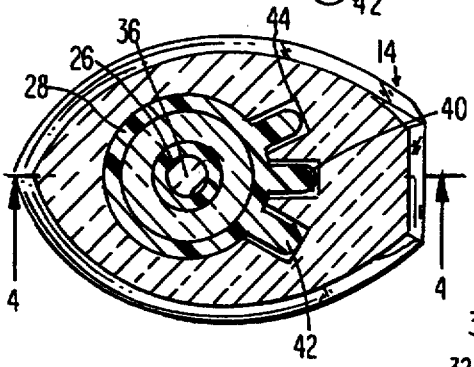
FIG. 3 is a sectional view taken on line 3—3 of FIG. 2.

FIG, 4 is an enlarged sectional view taken on line 4—4 of FIG. 3.

DETAILED DESCRIPTION OF THE PREFERRED EMBODIMENT

Figure 1:
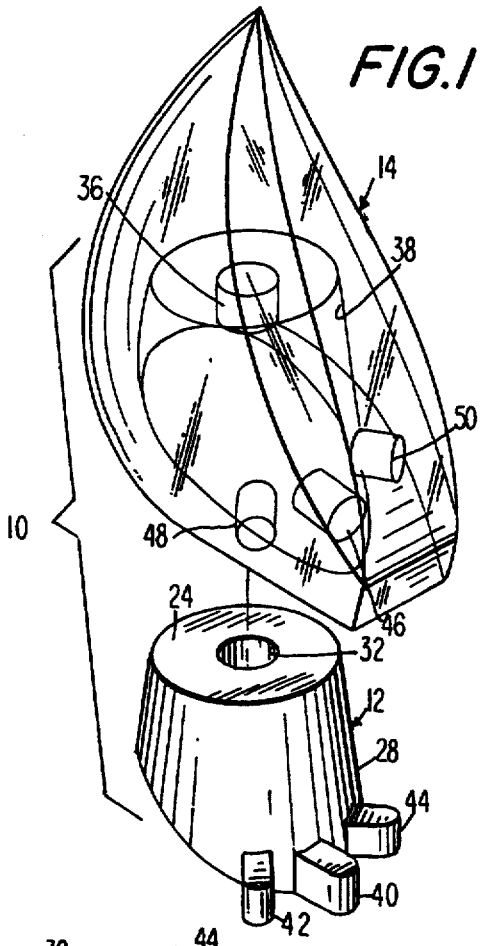
FIG. 1 is an exploded perspective view of a bottle closure in accordance with this invention.
Figure 2:
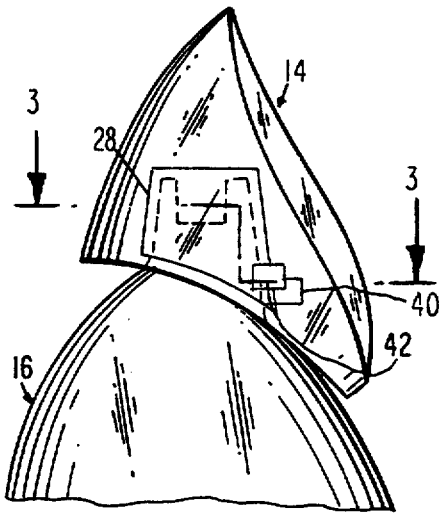
FIG. 2 is a broken-away, side elevational view of the bottle closure of FIG. 1 mounted on a bottle.
Figure 4:
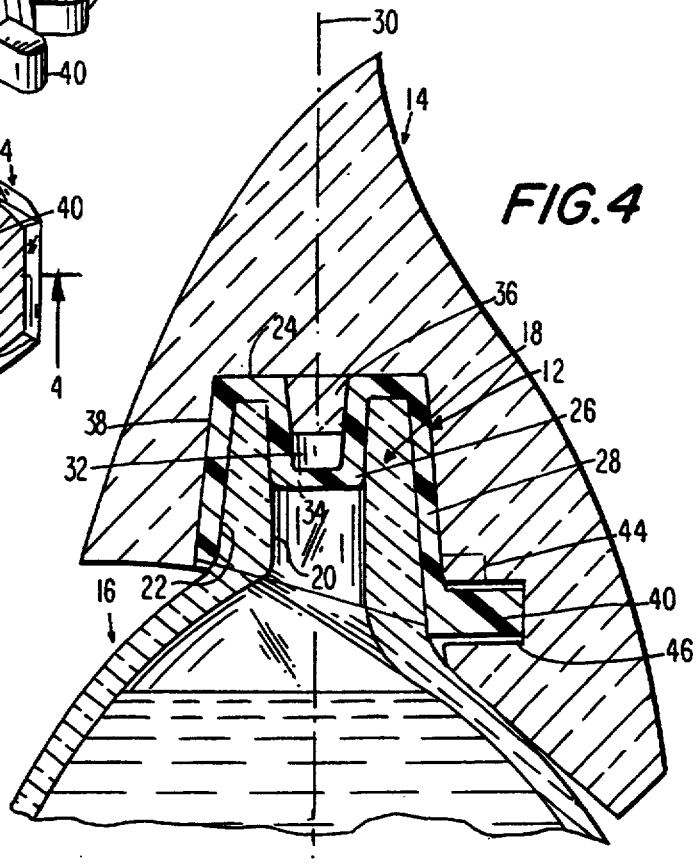

Referring now to the drawings, reference numeral 10 in FIG. 1 generally identifies a closure which comprises a stopper 12 and a crown 14. As best shown in FIG. 4, the closure 10 is mounted on a bottle 16 containing perfume. The bottle 16 has a neck 18 having an interior neck surface 20 bounding an opening, and an exterior neck surface 22 at the outside of the bottle.

Stopper 12 is molded of a resilient synthetic plastic material and has a generally planar top wall 24, an inner plug portion 26 extending along an upright longitudinal axis 30, and an outer skirt portion 28 extending circumferentially around the axis 30. The stopper 12 has a blind bore 32 extending through the top wall 24 and terminating in a bottom wall 34. The inner plug portion 26 has tapered circumferential walls that converge in a direction from the top wall 24 to the bottom wall 34. The inner plug portion is dimensioned to closely fit within the opening of the bottle neck 18.

The outer skirt portion 28 has oppositely tapered walls that converge in the direction from the top wall 24 to and past the bottom wall 34. The outer skirt portion 28 bounds a generally cylindrical space with the inner plug portion 26 and exteriorly engages the exterior neck surface 22. As best seen in FIG. 4, the perfume is tightly sealed within the bottle 16, because the bottom wall 34 overlies the neck opening, the tapered inner plug portion 26 friction-tightly engages the interior neck surface 20, the top wall 24 friction-tightly engages an exterior rim of the bottle, and the tapered outer skirt portion 28 friction-tightly engages the exterior neck surface 22.

The crown 14 is constituted of glass and, as shown, preferably has a sculptured, streamlined shape. The crown 14 has a mounting pin 36 that extends along the axis 30 and is mounted in a wedged engagement within the bore 32 of the stopper. The crown 14 has an interior cavity 38 of complementary contour to the stopper.

In order to mount the crown on the stopper, a plurality of projections 40, 42, 44 are molded of one-piece construction with the stopper 12. The projections extend radially of the axis 30 and outwardly away from the skirt portion 28. The projections diverge apart from one another outwardly of the skirt portion. Adjacent projections extend along radial lines that include an acute angle with each other. Preferably, each acute angle is on the order of 30°. The central projection 40 is, as best shown in FIG. 4, at a lower elevation, as compared to the outer projections 42, 44. All of the projections are at a lower elevation than the bottom wall 34.

The crown has a corresponding plurality of recesses 46, 48, 50 extending radially of the axis 30. The recesses receive the projections with a snap-type action. The recesses diverge outwardly and are located at different elevations, all analogously to that described above for the projections 40, 42, 44.

The stopper 12 is assembled to the crown as follows:

First, the stopper is at least partially inserted into the cavity 38. The mounting pin 36 is guided into the bore 32. Pressure exerted against a bottom edge of the stopper causes the interior walls of the crown to push the projections inwardly and, in the process, to partly deform the side of the outer skirt portion at which the projections are located. It will be remembered that the interior crown walls being made of glass are harder and more rigid than the more resilient plastic of the stopper. Continued pressure eventually causes the projections to overlie the recesses, whereupon the deformed side of the outer skirt portion biases the projections to enter the recesses, thereby completing the assembly.

It will be understood that each of the elements described above, or two or more together, also may find a useful application in other types of constructions differing from the types described above.

While the invention has been illustrated and described as embodied in a bottle closure, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalents of the following claims.

What is claimed as new and desired to be protected by Letters Patent is set forth in the appended claims:

1. A bottle closure, comprising:

a) a stopper having an inner plug portion extending along a longitudinal axis, and an outer skin portion extending circumferentially around the longitudinal axis, said skirt portion having a plurality of projections extending radially of the longitudinal axis and outwardly away from the skin portion, at least one of the projections being located at a different elevation as considered along the longitudinal axis than the other projections; and b) a crown having a plurality of interior recesses extending radially of the longitudinal axis, at least one of the recesses being located at said different elevation of said at least one projection, said recesses receiving the projections with a snap-type action to mount the crown on the stopper.

2. The closure according to claim 1, wherein the inner plug portion has a blind bore extending along the longitudinal axis, and wherein the crown has a mounting pin also extending along the longitudinal axis, said pin being mounted in the bore.

3. The closure according to claim 1, wherein the stopper is constituted of a molded, resilient synthetic plastic material, and wherein the crown is constituted of a glass material.

4. The closure according to claim 1, wherein the outer skirt portion bounds a generally cylindrical space with the inner plug portion.

5. The closure according to claim 1, wherein there are three of said projections, all diverging apart from one another outwardly of the skirt portion.

6. The closure according to claim 5, wherein adjacent projections extend along radial lines that include an acute angle with each other.

7. The closure according to claim 6, wherein each acute angle is about 30°.

8. The closure according to claim 6, wherein a central one of the projections is at a lower elevation as compared to the remaining projections.

9. The closure according to claim 1, wherein the projections and the skirt portion are of one-piece, molded plastic construction.

* * * * *